US005769226A

United States Patent [19]

Arai

[11] Patent Number: 5,769,226

[45] Date of Patent: Jun. 23, 1998

[54] PACKAGE FOR FILM PRODUCT

[75] Inventor: Takuya Arai, Tokyo, Japan

[73] Assignee: Fuji Photo Film Co., Ltd., Kanagawa, Japan

[21] Appl. No.: 675,574

[22] Filed: Jul. 3, 1996

[30] Foreign Application Priority Data

Jul. 6, 1995 [JP] Japan ..... 7-171218

[51] Int. Cl.[6] ..... B65D 5/54

[52] U.S. Cl. ..... 206/455; 206/395; 229/243

[58] Field of Search ..... 206/389, 395, 206/455, 316.1; 229/207, 208, 232, 236, 243, 244

[56] References Cited

U.S. PATENT DOCUMENTS

| | | | |
|---|---|---|---|
| 3,572,576 | 3/1971 | Foser | 229/207 |
| 3,905,646 | 9/1975 | Brackmann et al. | 229/207 |
| 4,417,661 | 11/1983 | Roccaforte | 229/232 |
| 4,441,612 | 4/1984 | Kingsley et al. | 229/236 |
| 4,449,633 | 5/1984 | Johnson et al. | 229/207 |
| 4,550,834 | 11/1985 | Fletcher et al. | 229/207 |
| 4,643,315 | 2/1987 | Hopwood et al. | 229/236 |
| 5,064,072 | 11/1991 | Nakamura | 229/244 |

FOREIGN PATENT DOCUMENTS

| | | |
|---|---|---|
| 57-600001 | 12/1982 | Japan . |
| WO 82/02531 | 8/1982 | WIPO . |

*Primary Examiner*—Jimmy G. Foster
*Attorney, Agent, or Firm*—Young & Thompson

[57] ABSTRACT

A first break line is formed at a front part of a paper box for storing a film cartridge. Second and third lines connected with the first break line are formed on a top part (lid). The second and third break lines incline toward both edges of the top part. Fourth and fifth break lines connected with the second and third break lines are formed along a ridge part toward both corners of the top part. When the paper box is opened, the first break line is broken to lift the top part, the second and third break lines are broken by the lifting action. Then, the fourth and fifth break lines are broken sequentially, so that the paper box is opened. Therefore, the paper box can be opened on the first attempt.

17 Claims, 8 Drawing Sheets

PACKAGE FOR FILM PRODUCT

BACKGROUND OF THE INVENTION

1. Field of the Invention

The present invention relates to a package for a film product, and more particularly to a package for a film product, in which the film product such as a film cartridge which stores unexposed photographic film is sealed by a moistureproof plastic case, which is stored in a paper box.

2. Description of the Related Art

A film cartridge is sealed in a plastic case, and is sold over the counter in a packaging format in which the plastic case is stored in a paper box on which a brand name and other information are printed.

The above-mentioned type of the package for the film product is disclosed in a Utility Model Publication No. 57-60001. As shown in FIG. 11, in the package for the film product, an arc break line 3 is formed on a wall 1A (at the front in the figure) of a rectangular-parallelepiped paper box to extend to corners 2 and 2 of a wall 1B (at the top in the figure) next to the wall 1A. Two inclining break lines 5 and 5, which are connected to the break line 3, are formed on the wall 1A to extend to corners 4 and 4 of a wall 1C (at the bottom in the figure) next to the wall 1A. That is, in the package, the break line 3 is broken, and then the break lines 5 and 5 are broken as shown in FIG. 12. As a result, the paper box 1 is opened and the plastic case 6 (see FIG. 13) is taken out.

In the package of the Utility Model Publication No. 57-600001, however, the break line 3 and the break lines 5 and 5 must be broken in different directions in order for the paper box to be opened. Therefore, there is much trouble in order to take out the plastic case 6.

Furthermore, in the package, a broken portion 7, which is folded to the inside of the paper box 1 via the break line 3, touches the plastic case 6 during the breaking of the package (see FIG. 13). As a result, the break line 3 is difficult to break; therefore, the plastic case 6 cannot be taken out easily.

SUMMARY OF THE INVENTION

The present invention has been developed in view of the above-described circumstances, and has as its object the provision of a package for a film product, which makes it possible to open a paper box easily and to take out the film product without any trouble at the final stage of the opening.

In order to achieve the above-described object, the present invention, which comprises a case for sealing and storing the film product and a rectangular-parallelepiped paper box for storing the case, is characterized in that a break line is formed on at least one wall of the paper box so that an opening area of the paper box gradually widens on the wall, and a portion, which is first broken along the break line, is formed at a position corresponding to a corner space between the paper box and the film product stored in the paper box.

Moreover, in order to achieve the above-described object, the present invention, which comprises a case for sealing and storing the film product and a rectangular-parallelepiped paper box for storing the case, is characterized in that the paper box has the first break line, which is formed on the first wall next to the lid of the paper box so that ends of the first break line are positioned on the first ridge line between the first wall and the lid, the second break line, which is formed on the lid and inclines so that one end of the second break line connects to one end of the first break line and the other end of the second break line is positioned on the second ridge line between the lid and the second wall next to the first wall, the third break line, which is formed on the lid and inclines so that one end of the third break line connects to the other end of the first break line and the other end of the third break line is positioned on the third ridge line between the lid and the third wall facing the second wall, the fourth break line which is formed along the second ridge line in such a manner that an end of the fourth break line connects to the other end of the third break line, and the fifth break line which is formed along the third ridge line in such a manner that an end of the fifth break line connects to the other end of the third break line; and the first break line is broken in order that the lid can be taken away so that the second and third break lines are broken, and then the fourth and fifth break lines are broken to open the lid.

According to one embodiment of the present invention, as the break line is broken, the opening area of the paper box widens gradually while the break line is being broken in one direction. Therefore, the film product can easily be taken out from the paper box. Furthermore, a part, which is first broken along the break line, is formed at a position corresponding to a space between the paper box and the film product stored in the paper box, so the first break line can be broken without any trouble.

According to another embodiment of the present invention, a corner space between the corner of the paper box and the film product stored in the paper box is used so that the first break line can be broken without any trouble.

According to yet another embodiment of the present invention, when the first break line on the first wall is broken to lift the lid, the second and third break lines are broken by the lifting action. Then, the fourth and fifth break lines are broken sequentially, so that the paper box is opened. As a result, the paper box can be opened by one action in the present invention.

According to another embodiment of the present invention, the paper box is put together in such a state that the fourth wall facing the first wall is separated from the second and third wall. The fourth wall is opened together with the lid. In the present invention, when the lid is opened, the fourth wall at the back of the lid is also opened. Thus, the film product can be taken out easily, and the explanations about how to use the film, which are printed on the lid and the fourth wall, can easily be read.

According to a yet further embodiment of the present invention, the case storing the film product is a cylinder, having a cross-section which section is substantially elliptic. When the first break line is broken, the case is folded to the inside of the paper box so that a part, which is first broken, enters the space between the paper box and the case.

According to another embodiment of the present invention, the second and third break lines are stepped, and a cutting part is formed in the opening direction of the lid. As a result, the second and third break lines are broken without any trouble, so the paper box can be opened smoothly.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
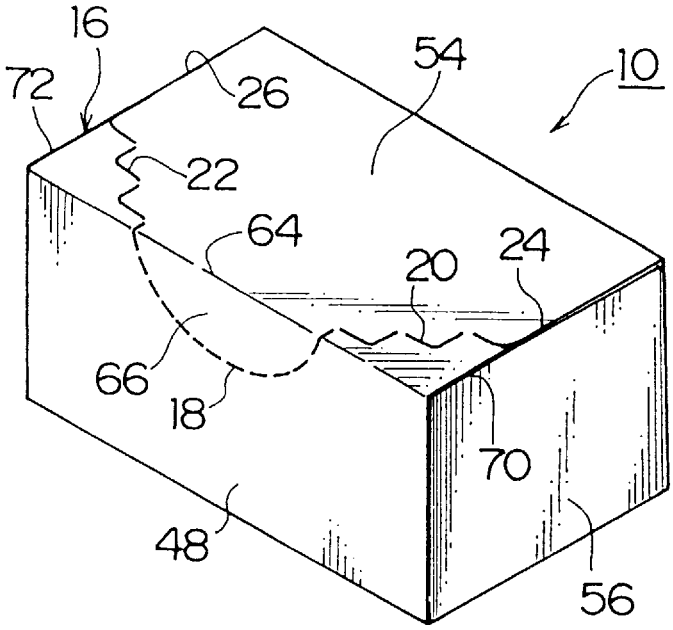
FIG. 1 is a perspective view illustrating an outer appearance of a film package according to an embodiment of the present invention.

FIG. 1 is a perspective view of the outside of a package for a film product. A package 10 in FIG. 1 stores a film cartridge 12 of FIG. 2. The film cartridge 12 is stored in a plastic case 14 of FIG. 3, and is stored in a paper box 16 of FIG. 1. A first break line 18, a second break line 20, a third break line 22, a fourth break line 24, and a fifth break line 26 are formed on the paper box 16. If these break lines 18, 20, 22, 24, and 26 are broken, the paper box 16 opens. As a result, the paper box 16 is taken out from the plastic case 14. The break lines 18, 20, 22, 24, and 26 will be described later.

Figure 2:
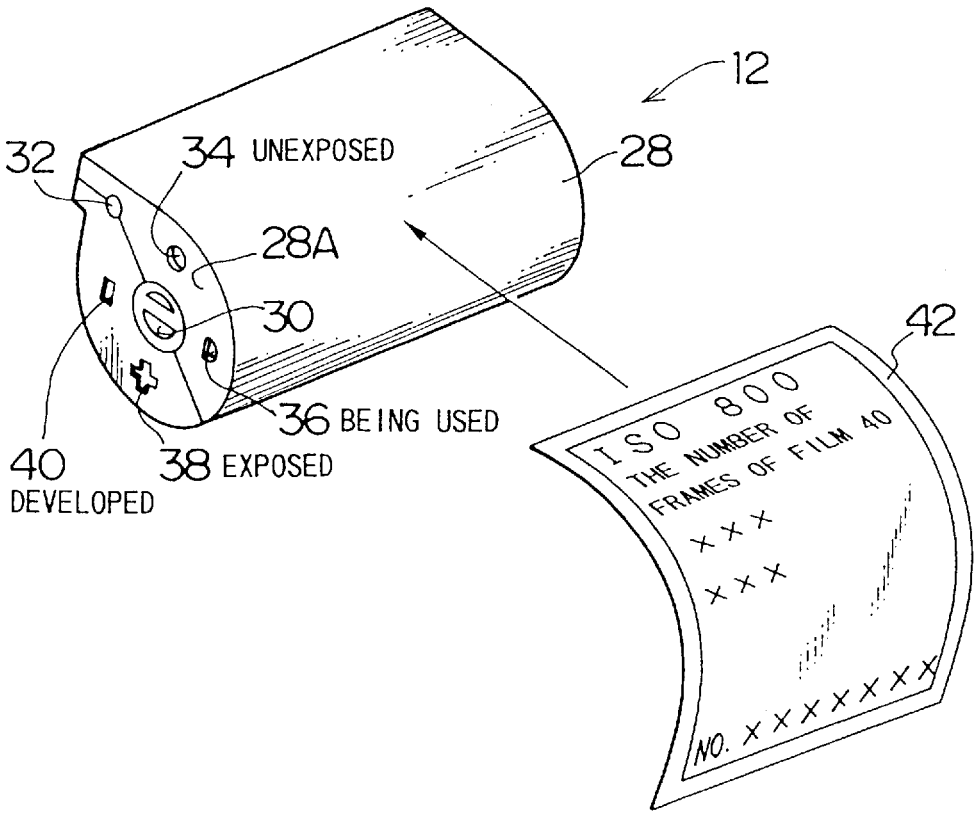
FIG. 2 is a perspective view illustrating an outer appearance of a plastic case which seals a film cartridge.

The film cartridge 12 of FIG. 2 consists of a body 28, a spool 30, and a light-blocking member 32, etc., which are made of plastic. The body 28 is a cylinder, having a cross-section which is substantially elliptic. The film cartridge 12 winds up the negative film into the body 28, and the negative film is taken out of the body 28 by the reverse rotation of the spool 30. Four different apertures 34, 36, 38, and 40 are spaced every 90° in a concentric circle on an end face 28A of the body 28. The apertures 34, 36, 38, and 40 indicate the condition of the film cartridge 12. A plate (not shown) for shielding one of the apertures 34, 36, 38, and 40 is rotatably provided around the spool 30 and within the apertures. For example, if the plate shields the circular aperture 34, it indicates that the unexposed negative film is loaded in the film cartridge 12. If the plate shields the semicircular aperture 36, it indicates that the film cartridge 12 has been used halfway. If the plate shields the cross-shaped aperture 38, it indicates that the exposed negative film is loaded in the film cartridge 12. If the plate shields the rectangular aperture 40, it indicates that the developed negative film is set in the film cartridge 12. The abovementioned determination can be made at a first glance from the outside. An explanation about how to use the film cartridge 12 is printed on the inside of the paper box 16 together with an explanation about how to use and expose the film, as shown in the development of the paper box 16 in FIG. 4.

As shown in FIG. 2, a label 42 is stuck on the surface of the film cartridge 12. An ISO range of the negative film set in the film cartridge 12, the number of frames of the film, an ID number of the film cartridge 12, and the like are printed on the label 42.

Figure 3:
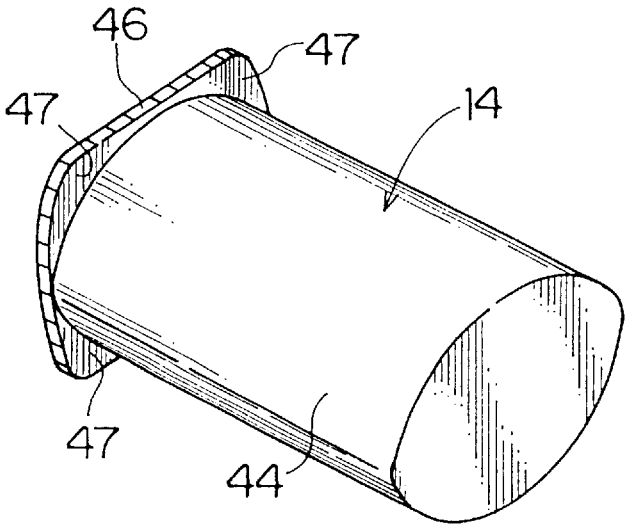
FIG. 3 is a perspective view illustrating an outer appearance of a film cartridge.

In FIG. 3, the plastic case 14 consists of a case's main body 44 and a cap 46. The section of the case's main body 44 is substantially elliptic so as to correspond to the external shape of the film cartridge 12. The cap 46 is rectangular, and a groove (not shown) is formed on the surface of the cap 46 to engage with an aperture (not shown) of the case's main body 44. Thus, when the cap 46 is closed, the film cartridge 12, which is inserted into the case's main body 44, is sealed and stored in the plastic case 14. Because the cap 46 is rectangular, four corners 47 project from the case's main body 44, when the cap 46 is closed. Since a user's fingers are easily placed on the corners 47 the cap 46 can be opened easily. Furthermore, the corners 47 are formed at four corners of the cap 46, so it is simple to open the cap 46 even if any part of the case's main body 42 is held.

Figure 4:
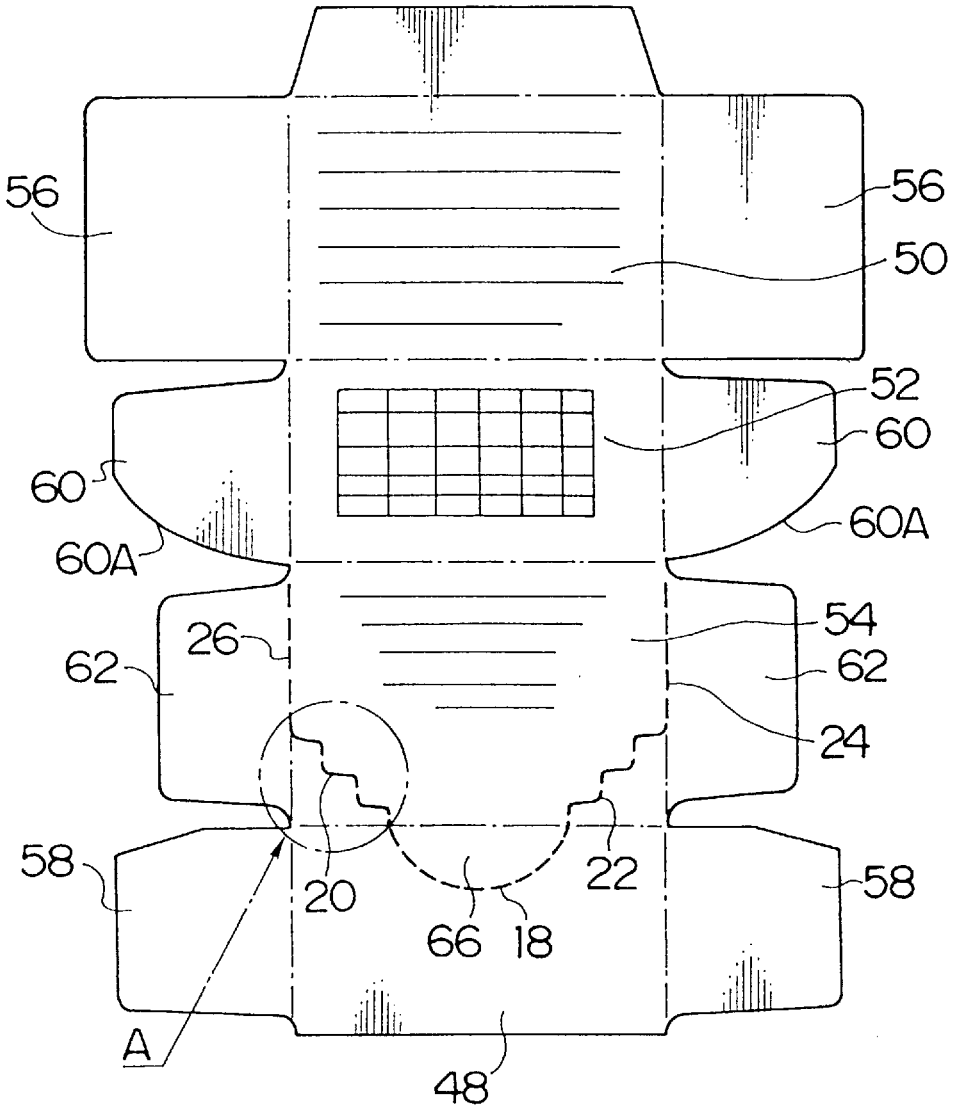
FIG. 4 is a development of a paper box in FIG. 1.

A piece of cardboard, which is shaped as shown in FIG. 4, is folded along a fold line in order to be put together as a rectangular-parallelepiped (see FIG. 1). A front panel (the first wall) 48, a bottom panel 50, a back panel (the fourth wall) 52, and a top panel (the lid 54) are formed in the paper box 16. A side panel (the second wall) 56 and a side panel (the third wall) 56 are formed at both edges of the bottom panel 50. Tabs 58 and 58 are formed at both edges of the front panel 48. Tabs 60 and 60 are formed at both edges of the back panel 52, and tabs 62 and 62 are formed at both edges of the top panel 54. The tabs 58 and 58, and the tabs 62 and 62 are affixed to the inside of the side panels 56 and 56. However, the tabs 60 and 60 are not affixed to, and are able to be separated from the side panels 56 and 56, the tabs 58 and 58, and the tabs 62 and 62. Therefore, when the break lines 18–26 are broken to open the top panel 54 (see FIG. 8), the back panel 52 is also opened (see FIG. 9). Edges 60A and 60A of the tabs 60 and 60 are arc-shaped so that they do not touch retained pieces 54A and 54A of the top panel 54 when the back panel 52 is opened.

Next, the break lines 18, 20, 22, 24, and 26 of the paper box 16 are explained.

Figure 7:
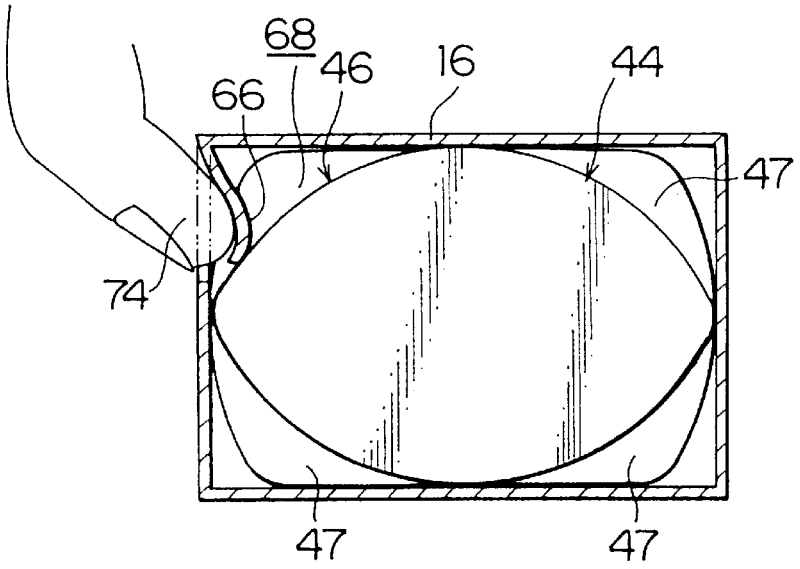
FIG. 7 is a side section view illustrating a paper box in a state when the first break line is broken.

As shown in FIG. 1., the break line 18 is formed on the front panel 48, and the ends of the break line 18 are positioned on a ridge line 64 between the front panel 48 and the top panel 54. The break line 18 is formed to the ridge line of the front panel 64. A broken portion 66, which is broken along the break line 18 and is folded to the inside of the paper box 16, is a semicircle, which is substantially the same shape as the tip of the thumb. Moreover, as shown in FIG. 7, the broken portion 66 can enter a corner space between the paper box 16 and the plastic case 14, when the broken portion 66 is folded to the inside of the paper box 16. As a result, the break line 18 is broken smoothly only if pushed inward, without an hindrance by the plastic case 14.

As shown in FIG. 1, the break line 20 is formed on the top panel 54, and one end of the break line 20 connects to one end of the break line 18 (the right end in the figure). The break line 18 inclines in such a manner that the other end of the break line 20 is positioned on a ridge line 70 between the top panel 54 and the side panel 56 at the right side in the figure. The break line 22 is formed opposite to the break line 20. That is, the break line 22 inclines so that one end of the break line 22 connects to the other end of the break line 18 (the right end in the figure), and the other end of the break line 18 is positioned on a ridge line 72 between the side panel 56 and the top panel 54.

Figure 5:
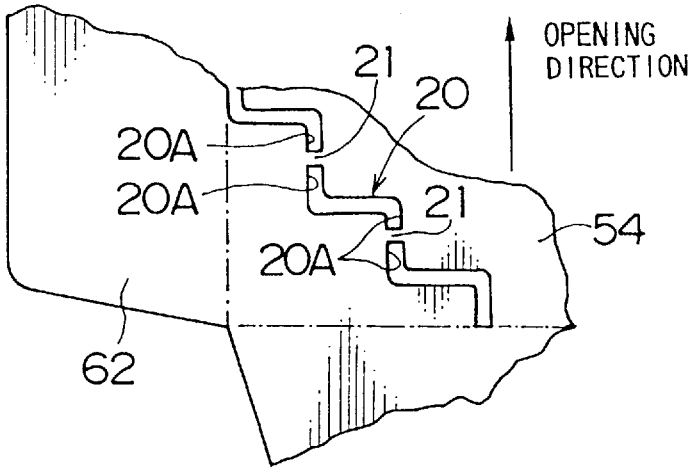
FIG. 5 is an enlarged view of a portion A in FIG. 4.

Furthermore, the break line 20 is shaped like steps as shown in FIG. 5, and connecting panels 21 and 21 are formed between cutting grooves 20A and 20A which are parallel to an opening direction of the top panel 54. As a result, if the top panel 54 is lifted in the opening direction, the connecting panels 21 and 21 are broken in the opening direction by the force. Therefore, the break line 20 is easily broken. Incidentally, the break line 22 is shaped just like the break line 20, so an explanation of it is omitted.

On the other hand, the break line 24 is formed along the ridge line 70 as shown in FIG. 1 so that one end of the break line 24 connects to the break line 20, and the other end of the break line 24 is positioned at a corner of the top panel 54 (the right corner in the figure). The break line 26 is formed opposite to the break line 24, or on the ridge line 72. One end of the break line 26 connects to the break line 22, and the other end of the break line 26 is positioned at the corner of the top panel 54 (the left corner in the figure).

Next, an explanation will be given about how to open the paper box 16 which is constructed in the above-mentioned manner.

First, as shown in FIG. 7, the tip of a thumb 74 pushes the broken portion 66 to the inside of the paper box 16 so as to break the break line 18. In this case, since the broken portion 66 is in a size to enter the corner space 68 between the paper box 16 and the plastic case 14, the break line 18 can be broken with one touch of the finger, without the hindrance by the plastic case 14.

Figure 6:
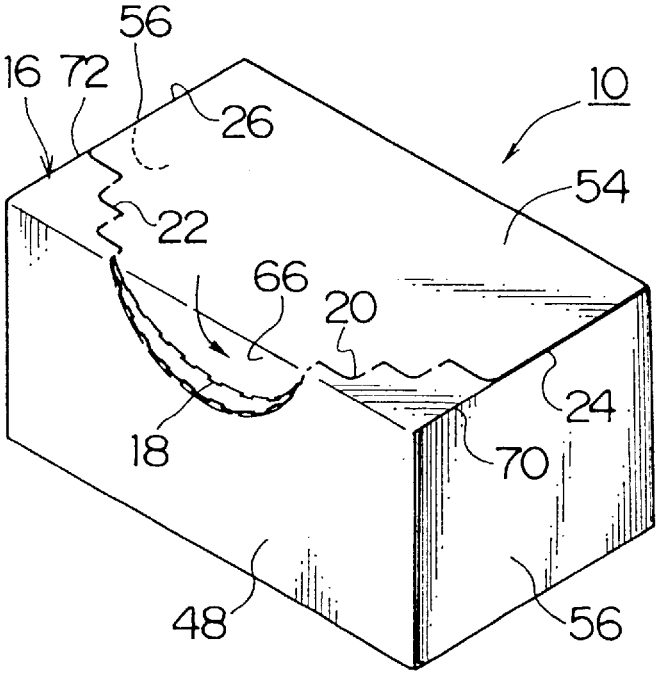
FIG. 6 is a perspective view illustrating an outer appearance of a paper box in a state that the first break line is broken.
Figure 8:
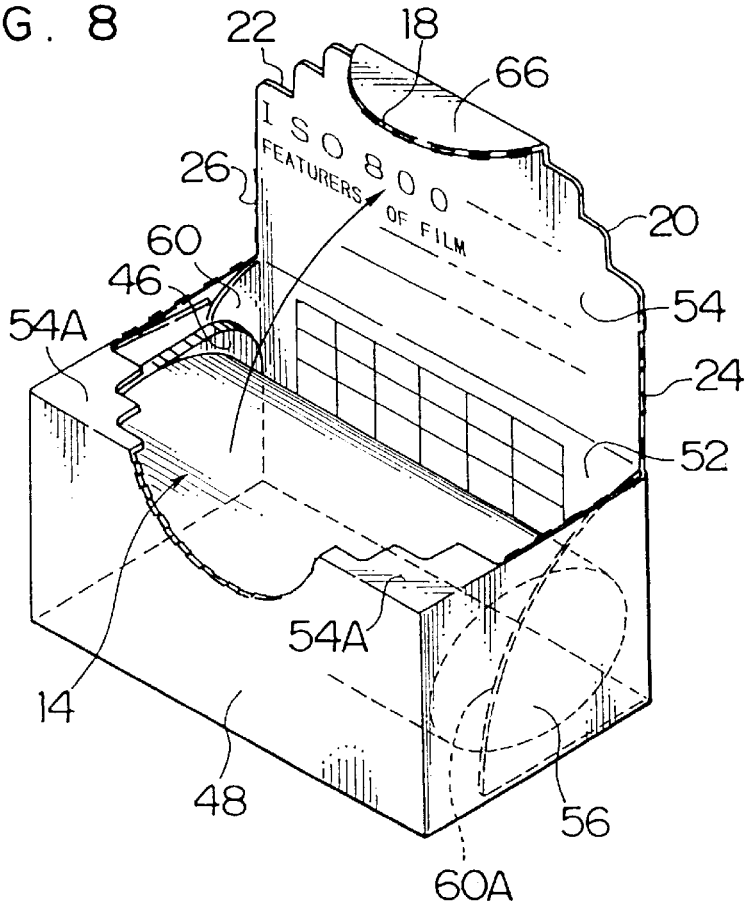
FIG. 8 is a view illustrating an outer appearance of a paper box in which a top part is opened along the break line.
Figure 9:
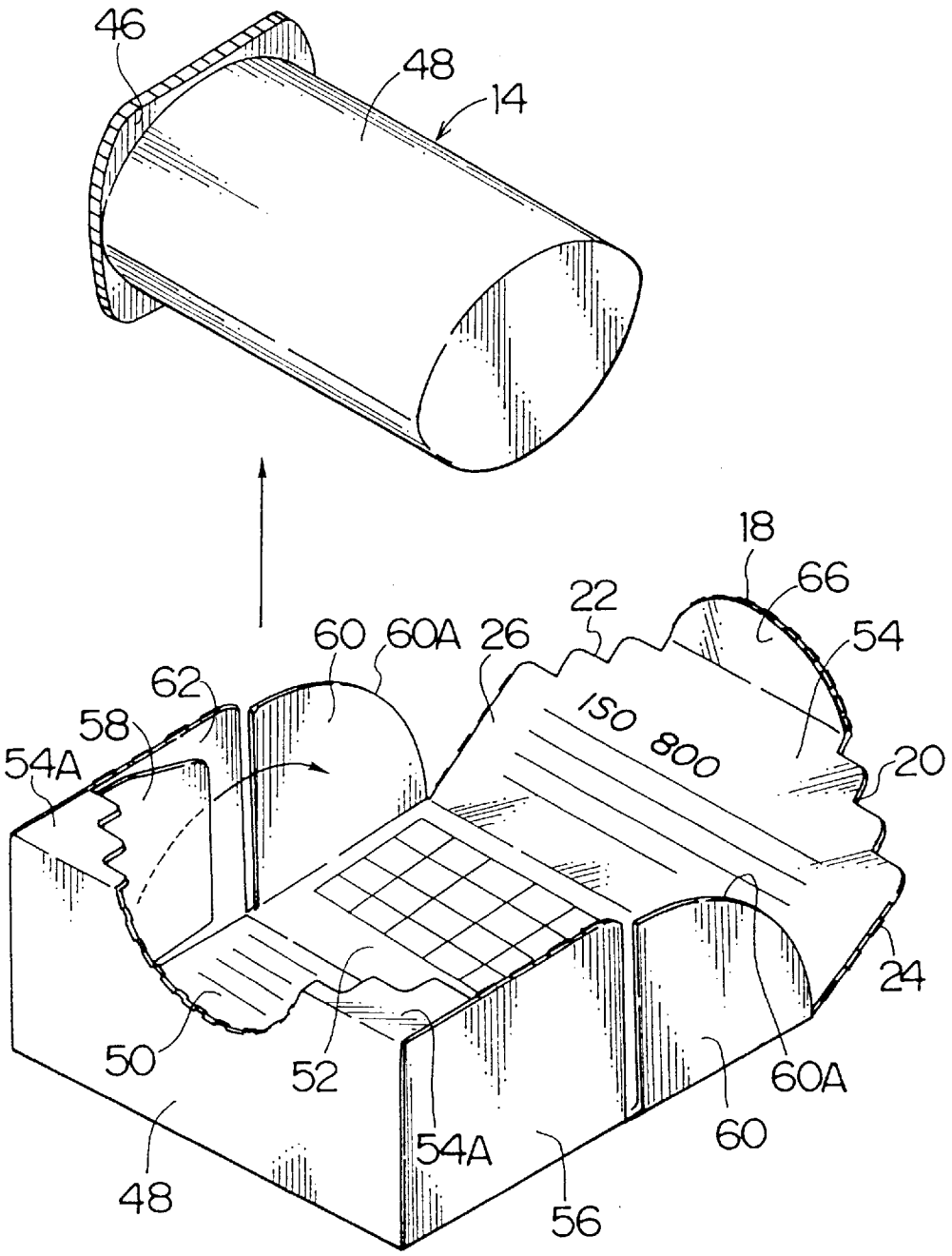
FIG. 9 is a view illustrating an outer appearance when a top part and a back part are opened and the film cartridge is taken out.

Next, if the finger is placed on the broken portion 66, which has been folded to the inside of the paper box 16, to lift the top panel 54, the second and third break lines 20 and 22 (see FIG. 6) are broken by the action. Then, the fourth and fifth break lines 24 and 26 are broken sequentially. As a result, the paper box 16 opens as shown in FIG. 8. When the paper box 16 is opened, the second and third break lines 20 and 22 are broken easily because the connecting panels 21 and 21 are formed between the cutting grooves 20A and 20A which are parallel to the opening direction of the top panel 54. The fourth and fifth break lines 24 and 26 are also broken smoothly because they are formed in the opening direction. Therefore, the paper box 16 can be opened easily on the first attempt, and the plastic case 14 can be taken out without much force at the final stage of the opening.

As shown in FIG. 8, when the paper box 16 opens, the back panel 52 opens together with the top panel 54 because the back panel 52 is separated from the side panels 56 and 56. In this case, because the edges 60A and 60A of the tabs 60 and 60 of the back panel 52 are arc-shaped, the tabs 60 and 60 do not touch the retained pieces 54A and 54A of the top panel 54 when the back panel 52 is opened. Therefore, the back panel 52 is opened smoothly.

As a result, the plastic case 14 is easily taken out from the paper box 16. Moreover, when the plastic case 14 is taken out, the explanation about how to use the film, which is printed on the inside of the paper box 16, is easy to read.

As has been described above, in the package 19 in this embodiment, the break lines 18, 20, 22, 24, and 26, which are broken sequentially by one opening operation, are box-shaped. Therefore, the paper box can be opened easier than the conventional package.

In this embodiment, the paper box 16 is formed out of a piece of cardboard, which is shaped as shown in FIG. 4. However, any pattern of the paper box 16 will do if the paper box can be put together as a rectangular-parallelepiped as shown in FIG. 1.

Figure 10:
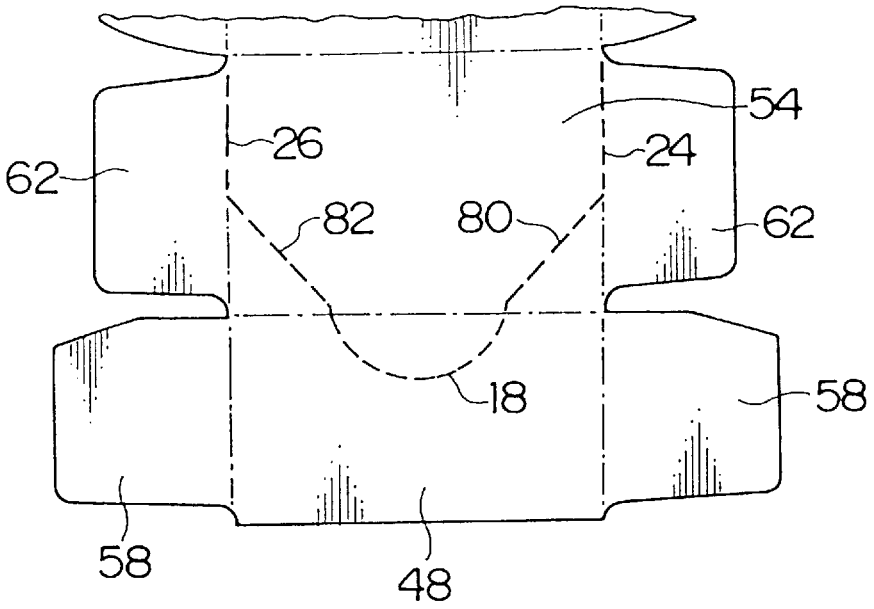
FIG. 10 is a development of essential portions in another embodiment of the second break line.
Figure 11:
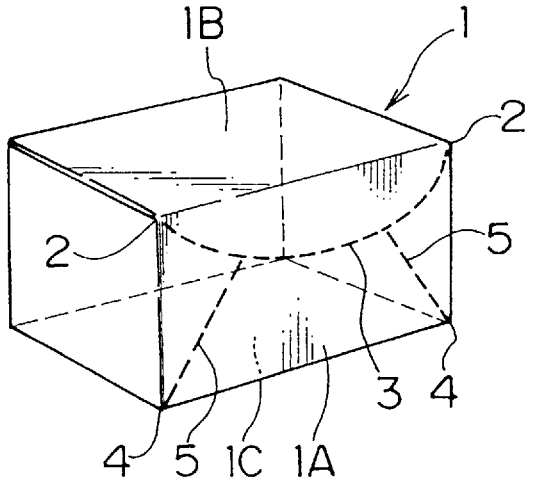
FIG. 11 PRIOR ART
FIG. 11 is a view illustrating an outer appearance of the conventional film package.
Figure 12:
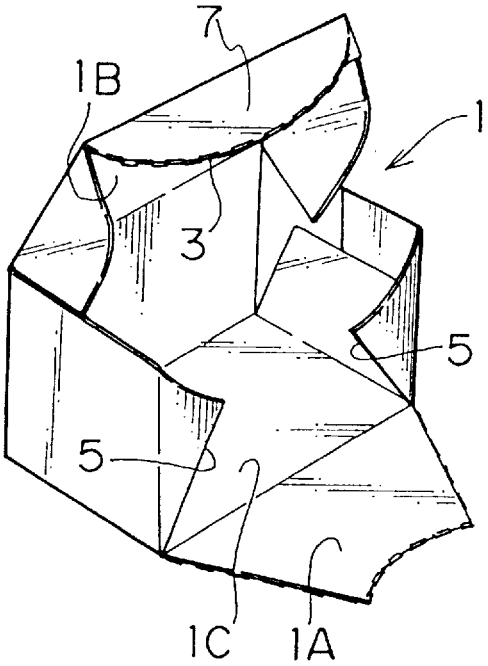
FIG. 12 PRIOR ART
FIG. 12 is a view illustrating an outer appearance when the paper box of FIG. 11 is opened.
Figure 13:
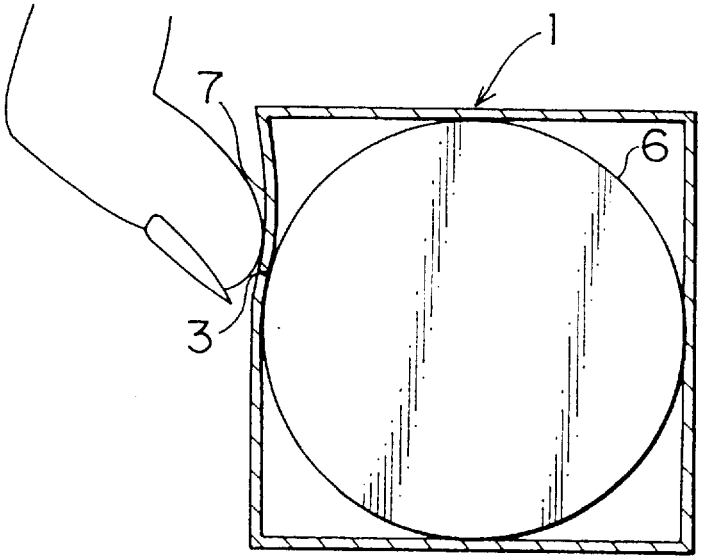
FIG. 13 PRIOR ART
FIG. 13 is a side section view when the paper box of FIG. 11 is broken along the break line.

Moreover, the break lines 20 and 22 are shaped like steps in this embodiment. However, the present invention is not limited to this. Straight break lines 80 and 82 may be adopted as shown in FIG. 10.

Furthermore, the package for the film cartridge 12 has already been explained in this embodiment. However, the present invention is not limited to this. The package may be used for a film unit with a lens, which is a simplified camera, and others.

As has been described above, according to the film package of the present invention, when the break lines are broken, the opening area of the paper box widens gradually. As a result, the film product can be taken out easily from the paper box. Moreover, since the portion, which is first broken along the break line, is formed at a position corresponding to a corner space between the paper box and the film product, which is stored in the paper box. Therefore, the break lines can be broken easily.

Furthermore, according to the present invention, when the first break line, which is formed on the first wall, is broken in order to lift the lid, the second and third break lines are broken by the lifting action. Then, the fourth and fifth break lines are broken sequentially so that the paper box is opened. Therefore, the paper box can be opened easily, and the film product can be taken out without any trouble at the final stage of the opening.

In this embodiment, the package for the film product consists of the case and the paper box; however, the present invention is not limited to this. For example, the present invention may be applied to a package wherein the film product is not stored in the case, but is stored in the paper box directly.

It should be understood, however, that there is no intention to limit the invention to the specific forms disclosed, but on the contrary, the invention is to cover all modifications, alternate constructions and equivalents falling within the spirit and scope of the invention as expressed in the appended claims.

I claim:

1. A package for a film product, comprising a rectangular-parallelepiped paper box, wherein:

the paper box has a semicircular first break line formed on a first wall next to a lid of the paper box and formed in such a manner that ends of the first break line are positioned on a first ridge line between the first wall and the lid, a second break line formed on the lid and inclining so that one end of the second break line is connected to one end of the first break line and the other end of the second break line is positioned on a ridge line between the lid and the second wall next to the first wall, a third break line formed on the lid and inclining so that one end of the third break line is connected to the other end of the first break line and the other end of the third break line is positioned on a third ridge line between the lid and a third wall facing the second wall, a fourth break line formed along the second ridge line in such a manner that an end of the fourth break line is connected to the other end of the second break line, and a fifth break line formed along the third ridge line in such a manner that an end of the fifth break line is connected to the other end of the third break line; and wherein the first break line is breakable to open the lid to break the second and third break lines, and then the fourth and fifth break lines are breakable to open the lid.

2. A package for a film product, comprising:

a case for sealing and storing the film product;

a rectangular-parallelepiped paper box enclosing the case, said paper box comprising a top panel, a bottom panel, a front panel having two tabs, a back panel, and a plurality of exterior side panels, said tabs being secured to said side panels, said front panel being attached to said top panel;

at least one break line formed on at least one of the panels of the paper box, wherein:

tearing along the at least one break line creates an opening in the paper box which widens gradually, said tearing further separating a major portion of the top panel from the exterior side panels, the entire back panel being adapted to be separated from the exterior side panels and hingeably attached to the bottom panel upon separation of the top panel from the exterior side panels, the front panel remaining secured to both the exterior side panels via the two tabs and a portion of the top panel.

3. The package for the film product according to claim 2, wherein at least a portion of the break line is formed on the front panel, a point on the portion of the break line on the front panel which is farthest from the top panel being located on a portion of the front panel which is separated by an open space from the enclosed case.

4. The package for the film product according to claim 3, wherein the portion of the break line on the front panel is semicircular.

5. A package for a film product according to claim 2, wherein the at least one break line is formed so that an opening area widens gradually over two of the panels of the paper box.

6. A package for a film product, comprising:

a case for sealing and storing the film product;

a rectangular-parallelepiped paper box enclosing the case, said paper box comprising a top panel, a bottom panel, a front panel, a back panel, a left side panel, and a right side panel;

a first break line formed on the front panel of the paper box, the ends of the first break line being located along an edge connecting the front panel to the top panel;

a second break line formed on the top panel, terminating at a forward end at the end of the first break line nearest the left side panel, and terminating at an aft end at a point along an edge between the top panel and the left side panel;

a third break line formed on the top panel, terminating at a forward end at an end of the first break line nearest the right side panel, and terminating at an aft end at a point along an edge between the top panel and the right side panel;

a fourth break line running along the edge between the top panel and the left side panel from the aft end of the second break line to the back panel; and a fifth break line running along the edge between the top panel and the right side panel from the aft end of the third break line to the back panel; wherein tearing along the first break line and lifting a separated portion of the front panel adjacent to the top panel causes tearing along the second and third break lines and then along the fourth and fifth break lines, separating a major potion of the top panel from the left and right side panels as well as from a portion of the front panel still connected to the right and left side panels, and allowing the back panel to pivot away from the left and right side panels by pivoting along an edge between the back panel and the bottom panel, the side panels remaining connected to the front panel.

7. The package for the film product according to claim 6, wherein the first break line is semicircular.

8. The package for the film product according to claim 6, wherein the second and third break lines are step shaped and comprise a plurality of perforations separated by connecting panels, and wherein segments of adjacent said perforations separated by the connecting panels are arranged in-line and are positioned generally parallel to the edges of the paper box connecting the top panel and the left and right side panels.

9. The package for the film product according to claim 8, wherein the first break line is semicircular.

10. The package for the film product according to claim 6, wherein:

the case is a cylinder with a substantially elliptical cross-section; and a point on the portion of the first break line which is farthest from the top panel is located on a portion of the front panel which is separated by an open space from the enclosed case.

11. The package for the film product according to claim 10, wherein the first break line is semicircular.

12. The package for the film product according to claim 6, wherein the back panel is connected to the top panel and the bottom panel along top and bottom edges, respectively, further comprising:

two tabs which extend, respectively, from opposite, remaining edges of the back panel, wherein the tabs are disposed within the paper box prior to the paper box's opening.

13. The package for the film product according to claim 12, wherein the tabs are shaped to allow the back panel to pivot without interfering with a portion of the top panel which remains connected to the one or more of the side panels and the front panel after the box's opening.

14. A package for a film product, comprising:

a rectangular-parallelepiped paper box, said paper box comprising a top panel, a bottom panel, a front panel, a back panel, a left side panel, and a right side panel;

a first break line formed on the front panel of the paper box, the ends of the first break line being located along an edge connecting the front panel to the top panel;

a second break line formed on the top panel, terminating at a forward end at the end of the first break line nearest the left side panel, and terminating at an aft end at a point along an edge between the top panel and the left side panel;

a third break line formed on the top panel, terminating at a forward end at an end of the first break line nearest the right side panel, and terminating at an aft end at a point along an edge between the top panel and the right side panel;

a fourth break line running along the edge between the top panel and the left side panel from the aft end of the second break line to the back panel; and a fifth break line running along the edge between the top panel and the right side panel from the aft end of the third break line to the back panel; wherein tearing along the first break line and lifting a separated portion of the front panel adjacent to the top panel causes tearing along the second and third break lines and then along the fourth and fifth break lines, separating a major portion of the top panel from the left and right side panels as well as from a portion of the front panel still connected to the right and left side panels, and allowing the back panel to pivot away from the left and right side panels by pivoting along an edge between the back panel and the bottom panel, the side panels remaining connected to the front panel.

15. The package for the film product according to claim 14, wherein the first break line is semicircular.

16. The package for the film product according to claim 14, wherein the second and third break lines are step shaped and comprise a plurality of perforations separated by connecting panels, and wherein segments of adjacent said perforations separated by the connecting panels are arranged in-line and are positioned generally parallel to the edges of the paper box connecting the top panel and the left and right side panels.

17. The package for the film product according to claim 16, wherein the first break line is semicircular.

* * * * *